United States Patent [19]

Hasegawa

[11] 4,217,737

[45] Aug. 19, 1980

[54] ABRASIVE FLAP DRUM

[75] Inventor: Hiroshi Hasegawa, Whittier, Calif.

[73] Assignee: Merit Abrasive Products, Inc., Compton, Calif.

[21] Appl. No.: 30,332

[22] Filed: Apr. 16, 1979

[51] Int. Cl.[2] ..... B24D 13/06

[52] U.S. Cl. ..... 51/334; 15/230.16; 15/230.17

[58] Field of Search ..... 15/230.16, 230.17, 230.19; 51/330, 331, 332, 334, 335, 336, 337, 376, 401, 402, 403, 404, 405, 406, 394

[56] References Cited

U.S. PATENT DOCUMENTS

| | | | |
|---|---|---|---|
| 2,826,776 | 3/1958 | Peterson | 51/336 X |
| 3,541,740 | 11/1970 | Radik | 51/332 |
| 3,619,948 | 11/1971 | Burns | 51/334 X |
| 3,747,285 | 7/1973 | Block | 51/334 X |
| 3,768,214 | 10/1973 | Belanger | 51/332 |
| 3,807,099 | 4/1974 | Belanger | 51/337 |
| 4,018,014 | 4/1977 | Belanger | 15/230.19 X |
| 4,055,028 | 10/1977 | Belanger | 51/334 |
| 4,055,919 | 11/1977 | Belanger | 51/334 |
| 4,080,714 | 3/1978 | Emerson | 51/334 X |

*Primary Examiner*—Gary L. Smith
*Assistant Examiner*—Robert P. Olszewski
*Attorney, Agent, or Firm*—Charles H. Schwartz

[57] ABSTRACT

An attachment means for an abrasive pack for use with an elongated hub having a plurality of spaced slots each extending along the length of the hub and with each pack formed of a plurality of abrasive flaps of abrasive material stacked together and with a plurality of the abrasive packs each extending outwardly from the hub and with each pack positioned adjacent an individual one of the slots, each attachment means, including a loop of sheet material having end portions and a loop portion, a thin supporting strip positioned adjacent the sides of the end portions of the loop to support and retain the end portions; and the supporting strip and end portions for disposition between individual flaps in the pack to have the loop portion extend outside the pack so that the loop may be retained within an individual one of the slots for locking the loop portion within the slot.

13 Claims, 7 Drawing Figures

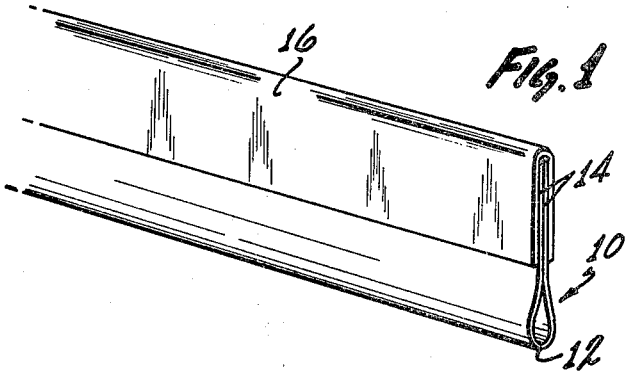
Fig. 1
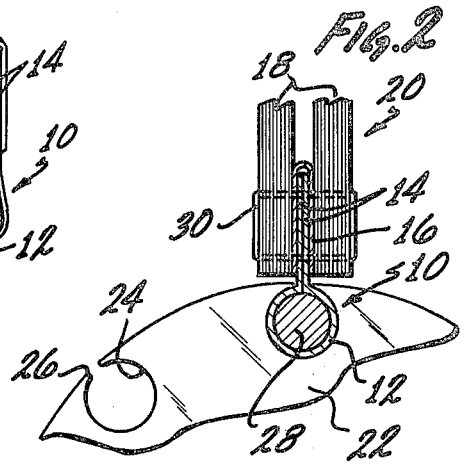
Fig. 2
Fig. 3
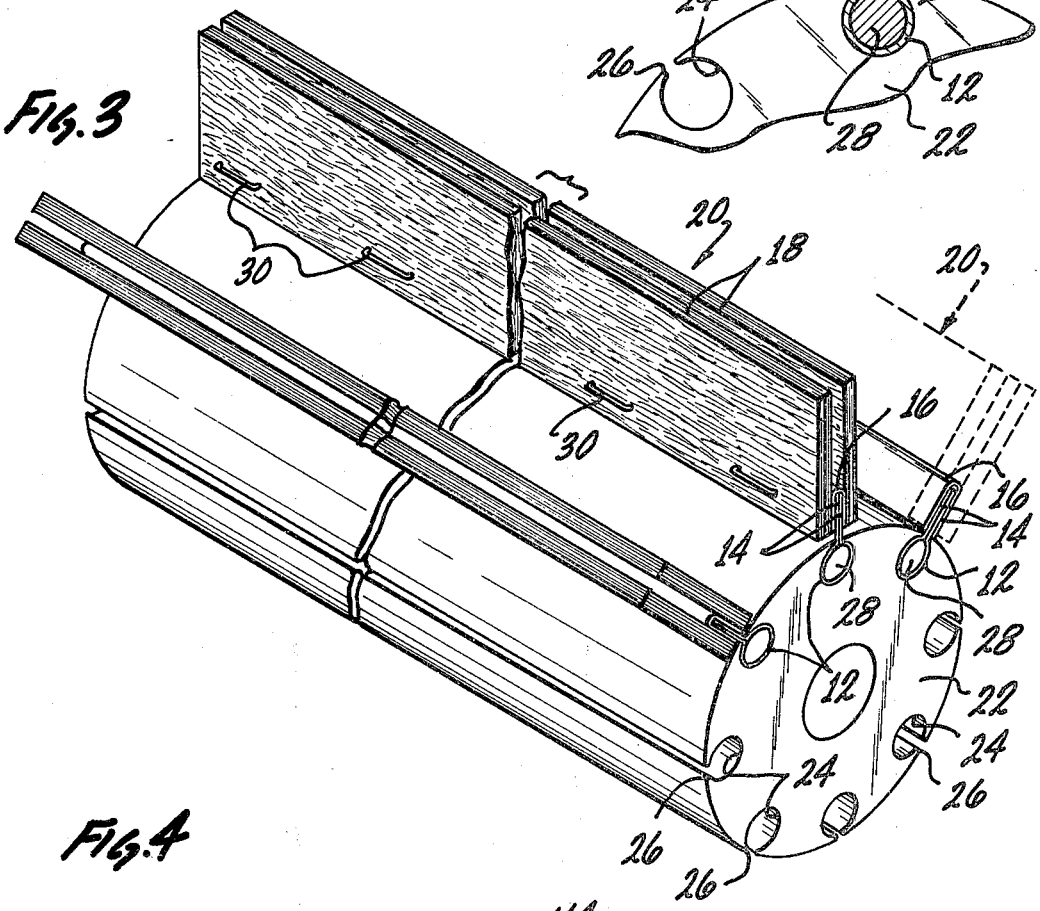
Fig. 4
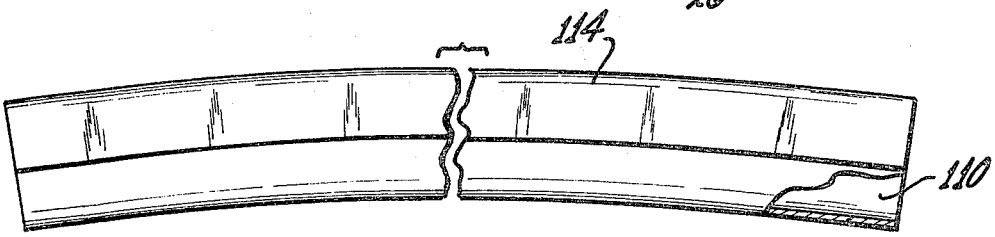

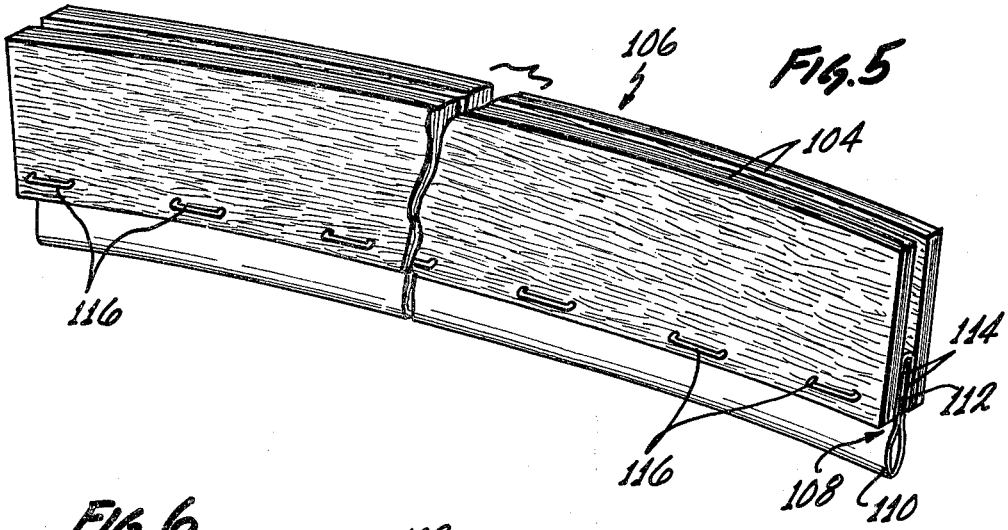
FIG. 5
FIG. 6
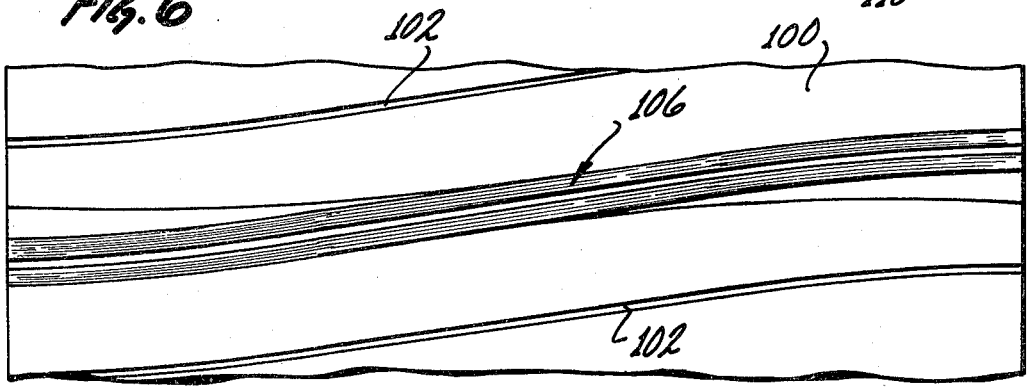
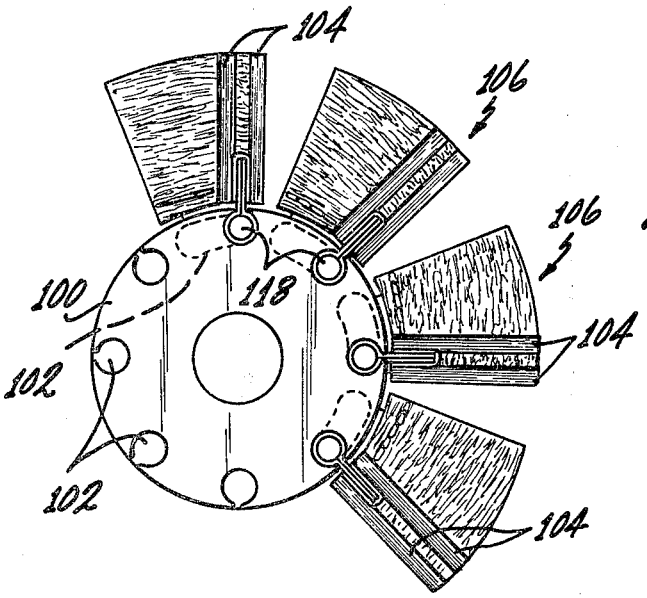
FIG. 7

ABRASIVE FLAP DRUM

The present invention is directed to an abrasive flap drum for providing for an abrasive action over a wide surface. Specifically, the present invention relates to means for mounting the abrasive packs to extend from the surface of a rotatable hub member. Generally, the rotatable hub includes a plurality of slots extending across the hub and with attachment means extending from each abrasive pack to be positioned within and retained by the slot. In the present invention, the attachment means includes a loop of sheet material (preferably neoprene-impregnated fabric) and with end portions of the loop of sheet material located between individual flaps of abrasive material forming the pack. In a particular embodiment of the invention, the end portions of the loop of sheet material are pressed together by a U-shaped sheet of thin supporting material such as metal. Specifically, a thin sheet of aluminum is formed to support the end portions of the loop of sheet material and to press the end portions together.

Large abrasive flap drums are currently used in industry for a number of purposes and with these flap drums providing for the abrasion over relatively wide area. For example, in the rolling of metal strip such as aluminum sheet into longer and thinner sheets, the rolling is accomplished using a large roll which exerts pressure on the sheet so as to form the sheet to progressively thinner and longer dimensions. As the roll contacts the aluminum sheet, it picks up base metal and oxide particles from the surface of the sheet. These particles would be returned to the sheet to mar the surface of the rolled sheet, unless the particles are cleaned from the roll at a position away from the contact with the aluminum sheet. An abrasive flap drum is located away from the aluminum sheet and at a position to contact the surface of the roll. The abrasive flap drum is rotated relative to the roll and provides for cleaning of the oxide particles and any other contaminents from the surface of the roll.

The abrasive flap drums have also been used for other industrial situations in order to provide for the abrasive action over a wide surface. For example, the abrasive flap drums are being increasingly used to descale hot rolled scale from steel. In the prior art the metal scale would be descaled by a chemical acid bath. These acid baths cause fumes and there are environmental problems with the disposal of the acid baths after use. In addition, the effectiveness of the acid bath decreases with use. In order to overcome these problems, abrasive flap drums are being used to provide for the descaling.

The individual packs are formed by cutting segments of a roll of abrasive material into individual flaps and with a plurality of flaps forming each individual pack. As disclosed in copending application Ser. No. 23,733, listing Alex Block as the inventor and assigned to the same assignee as the instant case, the abrasive material of the prior art devices typically has abrasive particles coated on the surface of a backing fabric. The backing fabric includes long and strong cloth fibers (warp), extending in a longitudinal direction along the length of the original roll of abrasive material. In the prior art devices, the flaps are cut from the roll of abrasive material and with each flap formed by cutting across the roll and against the long and strong fibers. As disclosed in the copending application, the flaps would tend to curl.

As disclosed in the copending application, the individual flaps may be cut from the large roll of abrasive material so that the face width dimension of each flap is in the direction of the length of the roll. Specifically, the individual flaps are cut from the roll in a longitudinal direction and by so cutting the flaps the long and strong fibers tend to impede the curling of the abrasive flaps.

As a further improvement in the construction of the abrasive flap drums as disclosed in the copending application, the flaps which make up the packs are cut with curved sides to have a banana shape. The slots in the hub are formed with a helical configuration to receive the attachment means for the individual packs. The cutting of the flaps with curved sides facilitates the positioning of the attachment means for the packs in the helical slots in the hub. This is because the helical slots in the hub provide for a curved shape for each slot as the slot extends helically across and around the periphery of the hub.

It is advantageous to use the helical slots since helically disposed packs on the hub provide for a number of advantages in the operation of the abrasive flap drum. Specifically, with the helical disposition of the packs, only one position of each flap hits the workpiece at each instant. The position of contact between the flap and workpiece moves along the length of the flap as the abrasive drum is rotated and the contact transfers from the end of one flap to the opposite end of the next flap during rotation. The progressively changing contact position minimizes the force upon the workpiece at each instant and also provides for a continuous uniform contact between the abrasive flaps and the workpiece, so as to provide for a smooth abrasive action. In addition, the progressive contact reduces the slapping of the flaps against each other and thereby reduces the noise.

In the copending application, the abrasive packs may be attached to the hub using a loop of sheet material which is stapled or stitched to the pack of abrasive flaps. Although the use of the loop of sheet material is an improvement over the prior art attachment means, the present invention provides for a further improvement in the attachment means in the use of a thin sheet of supporting material adjacent the sides of the end portions of the loop of sheet material. The thin sheet may be made of metal and may be folded into a U-shape so as to press the two end portions of the loop of sheet material together. The thin sheet of supporting material may also be used with an attachment means formed as a solid root member, such as a solid plastic member.

The thin sheet of supporting material provides support for the free end portion of the attachment means and also for the base portions of the abrasive packs and provides additional reinforcement to prevent the staples or stitches from pulling through the flaps. This structure, therefore, tends to solidify the base portions of the pack to give more stability to these base portions. However, even though the support means may be U-shaped and may be made from a thin sheet of metal such as aluminum, the support means are still resilient and bendable and can, therefore, respond on a compliant basis to the force exerted on the abrasive packs by the workpiece.

In addition to the above, when the support means is used with the abrasive packs formed from flaps cut with curved sides, the supporting strip may be made resilient and bendable enough so that the strip can adapt to the curved sides and can twist so that the supporting strip will follow the helical configuration of the helical slot in the hub. It is, of course, desirable that the supporting strip be able to twist at progressive positions along the length of the strip. This is because each abrasive pack faces in progressively different directions along its length since the helical slot causes each progressive position of the pack to have a different annular circumferential direction.

The use of the supporting strip for the attachment loop provides for an improved abrasive pack and allows for a smooth continuous contact between the flaps and the workpiece, while providing for sufficient strength to receive the forces exerted on the flaps by the workpiece.

A clearer understanding of the present invention will be had with reference to the following description and drawings, wherein FIG. 1 illustrates an attachment means formed from a loop of sheet material and a resilient U-shaped supporting strip;

FIG. 2 illustrates an individual abrasive pack coupled to a slot in a hub, using the attachment means of FIG. 1;

FIG. 3 illustrates a hub having straight slots and showing a plurality of abrasive packs supported by the attachment means of the present invention;

FIG. 4 illustrates a modification showing an attachment means bent into a curved shape;

FIG. 5 illustrates the attachment means of FIG. 4, supporting an abrasive pack formed of flaps having a curved shape;

FIG. 6 illustrates a portion of a hub showing helical slots to receive the pack of FIG. 5; and FIG. 7 illustrates a plurality of packs formed of curved flaps and each pack supported for extension from the hub by attachment means of the present invention.

FIG. 1 illustrates an attachment means of the present invention, including a loop 10 of sheet material formed as a loop portion 12 and end portions 14. The end portions 14 of the loop of sheet material are reinforced by a supporting strip 16, which in the specific example shown in FIG. 1, is constructed of a U-shaped thin strip of metal, such as aluminum. The supporting strip 16 presses together the two end portions 14 of the loop 10 of sheet material. By using the supporting strip 16 a reinforcement and a support is provided for the free end portions of the loop of sheet material.

Referring to FIG. 2, it can be seen that the attachment means is positioned between flaps of abrasive material 18. A plurality of the flaps of abrasive material 18 form a pack 20. The specific number of flaps would depend on the material used for the flaps and the size and spacing of the flaps around the circumference of a supporting hub 22. As shown in FIGS. 2 and 3, the supporting hub 22 includes a plurality of slots 24 and with each slot extending across the drum 22. The slots are shown to have a circular cross section and include a narrow opening 26 at the circumference of the hub 22.

As can be seen in FIGS. 2 and 3, the loop portion 12 of each attachment means is slid into one of the slots 24 and with a rod member 28 locking the loop portion in position within the slot. The attachment means and the individual flaps 18 forming a pack may be held together using means such as staples 30. It is to be appreciated, however, that in place of staples, the various members may be held together by other means, such as stitching. It can also be seen with reference to FIG. 3 that the slots 24 may extend straight across the drums and with the individual flaps 18 cut with straight sides so as to match the straight slot 24. The supporting strip 16 provides reinforcement and helps to prevent the staples or stitching from pulling through the flaps 18.

As a modification to the use of straight slots, the slots in the hub may have a helical configuration, so that the slots extend both across and partially around the hub. This may be seen with reference to FIGS. 6 and 7, wherein a hub 100 has helically arranged slots 102. The slots 102 have a similar cross section as those shown in FIGS. 2 and 3, and have a circular cross section with a narrow opening at the surface of the hub.

In order to properly attach the abrasive flaps in positions relative to the helical slots 102, individual flaps 104 forming an abrasive pack 106, are cut with oppositely disposed curved sides. The abrasive packs 106 are attached to the hub 100 in the same manner as the abrasive packs 20, and also use a loop 108 of sheet material having a loop portion 110 and end portions 112. A U-shaped supporting strip 114 supports the end portions 112. This structure is substantially the same as shown in FIGS. 1, 2 and 3. As shown in FIG. 4, the attachment means is flexible enough to allow for the attachment means to bend slightly so as to match the curved sides of the individual leaves 104 shown in FIG. 5. The attachment means and the individual flaps may be stapled together using staples 116 or may be sewn together so as to form the abrasive packs 106.

The loop 110 of sheet material is placed in the slots 102 and a flexible rod 118 is used to lock the loop in position. Since the supporting strip of 114 is made of a relatively resilient and bendable material such as thin aluminum, the aluminum will bend and twist to follow the configuration of the helical slot 102. This provides for the entire pack 106 also bending and twisting at progressive positions along the length of the pack 106. The pack 106 extends from the hub 100 a substantially constant distance from one end of the pack to the other.

As indicated above, having the packs helically arranged on the hub provides for progressive positions of each flap in the pack to contact the workpiece. This minimizes the force on the workpiece at each instance. Also, the contact between an individual flap and the workpiece transfers from one end of a particular flap to the opposite end of the adjacent flap. This provides for a substantially constant force between the flaps and the workpiece during rotation of the hub. The constant force tends to minimize the vibration of both the abrasive flap drum and the workpiece. The progressive contact also tends to reduce the noise caused by the flaps slapping against each other.

The present invention, therefore, provides for an improved attachment means for abrasive packs which extend from the circumference of a rotary hub. The attachment means includes a loop of sheet material having a loop portion and end portions and with the loop portion for attachment within a slot in the rotary hub. A supporting strip of thin material is adjacent the sides of the end portions of the loop of sheet material and tends to solidify the base portions of the pack. Since the supporting strip is made from a thin sheet of material such as aluminum, the supporting strip is also resilient and bendable. This allows the supporting strip to respond on a compliant basis to the force exerted on the packs by the workpiece. The supporting strip may also be used with an attachment means formed as a solid root member such as a solid plastic member. In addition, the supporting strip may extend along only one side of the end portion of the attachment means or may be between the end portions if the attachment means is made from a loop of sheet material. It is also to be appreciated that the supporting strip may be formed from materials other than metal such as plastic material. In general, the supporting strip is formed of material more dense and less flexible than the material forming the attachment means.

Although the application has been described with reference to particular embodiments, it is to be appreciated that various adaptations and modifications may be made and the invention is only to be limited by the appended claims.

I claim:

1. An abrasive pack for use with an elongated hub having a plurality of spaced slots each extending along the length of the hub and with a plurality of the abrasive packs each extending outwardly from the hub and each positioned adjacent an individual one of the slots, each pack including a plurality of abrasive flaps of abrasive material stacked together to form a pack;

a loop of sheet material having end portions and a loop portion;

a supporting strip positioned adjacent the sides of the end portions of the loop of sheet material to support and retain the end portions, and the supporting strip and the end portions disposed between individual flaps in the pack and with the loop portion without the pack for reception within an individual one of the slots for locking the loop portion within the slot.

2. The abrasive pack of claim 1 wherein the supporting strip is constucted of thin aluminum sheet material.

3. The abrasive pack of claim 1 wherein the supporting strip is U-shaped and with the end portions of the loop of sheet material received within the open end of the U-shaped supporting strip.

4. The abrasive pack of claim 3 wherein the end portions of the loop of sheet material completely fill the U-shaped supporting strip.

5. The abrasive pack of claim 1 wherein the individual slots are each formed as a helix with progressive positions of each slot rotated angularly and with the abrasive pack, supporting strip and loop of sheet material flexible to follow the curvature of the helix.

6. The abrasive pack of claim 5 wherein the individual flaps have curved edges in the direction along the length of the slot to follow the curvature of the helix.

7. An attachment means for an abrasive pack for use with an elongated hub having a plurality of spaced slots each extending along the length of the hub and with each pack formed of a plurality of abrasive flaps of abrasive material stacked together and with a plurality of the abrasive packs each extending outwardly from the hub and with each pack positioned adjacent an individual one of the slots, each attachment means, including a loop having an end portion and a loop portion;

a supporting strip positioned adjacent to sides of the end portion of the loop to support and retain the end portion; and the supporting strip and end portion for disposition between individual flaps in the pack to have the loop portion extend outside the pack so that the loop portion may be retained within an individual one of the slots for locking the loop portion within the slot.

8. The attachment means of claim 7 wherein the loop is formed of sheet material and the loop portion is an open loop.

9. The attachment means of claim 7 wherein the thin supporting strip is constructed of aluminum sheet material;

10. The attachment means of claim 7 wherein the thin supporting strip is U-shaped and with the end portion of the loop received within the open end of the U-shaped supporting strip;

11. The attachment means of claim 10 wherein the end portion of the loop completely fill the U-shaped supporting strip.

12. The attachment means of claim 7 for use with a hub wherein the individual slots are each formed as a helix with progressive positions of each slot rotated angularly and with the supporting strip and loop flexible to follow the curvature of the helix.

13. The attachment means of claim 12 wherein the individual flaps have curved edges in the direction along the length of the slot to follow the curvature of the helix and with the supporting strip and loop flexible to follow the curvature of the flaps.

* * * * *